US006421900B1

(12) United States Patent
Hunt

(10) Patent No.: US 6,421,900 B1
(45) Date of Patent: Jul. 23, 2002

(54) AUTOMATIC NUTPLATE DIE

(75) Inventor: Anthony J. Hunt, Los Angeles, CA (US)

(73) Assignee: TRW Inc., Redondo Beach, CA (US)

( * ) Notice: Subject to any disclaimer, the term of this patent is extended or adjusted under 35 U.S.C. 154(b) by 106 days.

(21) Appl. No.: 09/677,318

(22) Filed: Sep. 29, 2000

(51) Int. Cl.[7] ..... B23P 11/00

(52) U.S. Cl. ..... 29/243.53; 29/243.521; 269/3; 269/6

(58) Field of Search ..... 29/243.53, 257, 29/243.51, 243.55, 243.56, 243.521, 276, 283; 269/6, 3, 249, 143

(56) References Cited

U.S. PATENT DOCUMENTS 2,365,538 A * 12/1944 Fischer ..... 29/281.5
5,535,506 A * 7/1996 Chalfin ..... 29/281.5
5,713,117 A * 2/1998 Bliss ..... 29/257
6,276,050 B1 * 8/2001 Mauer et al. ..... 29/16

* cited by examiner

*Primary Examiner*—Joseph J. Hail, III
*Assistant Examiner*—Lee Wilson
(74) *Attorney, Agent, or Firm*—Harness, Dickey & Pierce, P.L.C.

(57) ABSTRACT

An automatic nutplate die (70) that is used to align a plurality of rivet punches (116, 118) with rivets (24) being used to secure a nutplate (22) to a part (26) by a rivet squeezer (62). The nutplate die (70) includes a nutplate platen (74) and a punch platen (76) secured to each other by a pair of stripper bolts (78, 80). The stripper bolts (78, 80) included threaded portions (104,108) that are threaded into the punch platen (76), and heads (96, 100) that are positioned within counter-sunk bores (98, 102) in the nutplate platen (74). A spring (84, 90) is positioned on the shaft (86, 92) of each of the bolts (78, 80). The rivet punches (116, 118) are rigidly secured to the punch platen (76) and are slidably engaged within opposing bores (120, 122) in the nutplate platen (74). The nutplate platen (74) includes a cavity (124) that accepts the nutplate (22) so that holes in the nutplate (22) are aligned with the punches (116, 118).

10 Claims, 4 Drawing Sheets

AUTOMATIC NUTPLATE DIE

BACKGROUND OF THE INVENTION

1. Field of the Invention

This invention relates generally to a die for holding a nutplate and for aligning rivets relative thereto and, more particularly, to an automatic nutplate die for holding and aligning a plurality of rivets with holes in the nutplate and holes in a structure that the nutplate is being secured to so that the rivets can be simultaneously formed by a single operation of a rivet squeezer.

2. Discussion of the Related Art

Nutplates are often used to connect various parts and components together for different applications, such as aircraft bulkheads and the like. A nutplate is a connector assembly that includes a base plate having edges that are formed to loosely hold a connector to the nutplate. Each nutplate is secured to a part by a pair of rivets, where the connector is typically positioned between the rivets. Cooperating nutplates are secured to another part, and the connectors are engaged to connect the parts together. Certain assemblies, such as certain spacecraft assemblies, may employ more than 3000 nutplates.

The base plate of the nutplate and the part that the nutplate is being mounted to include pre-drilled holes. The assembler aligns a hole in the base plate with the appropriate hole in the part, and then pushes a rivet through a back side of the part so that it extends through the base plate of the nutplate. The rivet includes a head that is positioned within a counter sunk bore in the back side of the part. The other rivet is then pushed through the part and the nutplate in the same manner. A cap block is held against the two rivets to hold them in place prior to forming the rivets. The assembler to aligns a punch of a rivet squeezer with the unformed end of one of the rivets opposite to the counter sunk bore, and then forms the end of the rivet with the squeezer to secure the nutplate to the part. The operator then aligns the punch of the squeezer with the other rivet to form it in the same manner. Thus, the nutplate is securely attached to the part. Different types of nutplates are known in the art and different types of rivet squeezers are used to secure the nutplates to the part.

Installing nutplates in this manner is extremely labor intensive and time-consuming. Additionally, because the operator is required to align the punch of the squeezer with the rivets, a certain amount of skill is required to accurately perform the riveting process. If the punch and rivet are not properly aligned, the poorly punched rivets must be drilled out, possibly damaging the nutplate in the process, and further adding to the cost of the process.

What is needed is a device for aligning the punch with the rivet when assembling a nutplate to a part to provide a more cost-effective way to speed up the riveting process. It is therefore an object of the present invention to provide such a device.

SUMMARY OF THE INVENTION

In accordance with the teachings of the present invention, an automatic nutplate die is used to align a plurality of rivet punches with a plurality of rivets being used to secure a nutplate to a part by a rivet squeezer. The nutplate die includes a nutplate platen and a punch platen secured to each other by a pair of stripper bolts. The stripper bolts included threaded portions that are threaded into the punch platen, and bolt heads that are positioned within counter-sunk bores in the nutplate platen. A spring is positioned on the shaft portion of each of the bolts. The rivet punches are rigidly secured to the punch platen, and are slidably engaged within opposing bores in the nutplate platen. The nutplate platen includes a cavity that accepts the nutplate so that holes in the nutplate are aligned with the bores and the punches.

The nutplate is positioned within the cavity, and the rivets are positioned through the part and the nutplate while it is in the cavity. Activation of the rivet squeezer causes the nutplate platen to move toward the punch platen against the bias of the springs so that the punches move through the bores and contact the unformed ends of the rivets, thus forming the ends of the rivets to secure the nutplate to the part. In this manner, both of the rivets are formed with one operation of the squeezer. When the squeezer is released, the springs cause the nutplate platen to move away from the punch platen until the heads of the stripper bolts contact the counter-sunk bores.

Additional advantages and features of the present invention will become apparent to those skilled in the art from the following discussion and the accompanying drawings and claims.

DETAILED DESCRIPTION OF THE PREFERRED EMBODIMENTS

The following discussion of the preferred embodiments directed to an automatic nutplate die used in connection with a rivet squeezer is merely exemplary in nature, and is in no way intended to limit the invention or its applications or uses.

Figure 1:
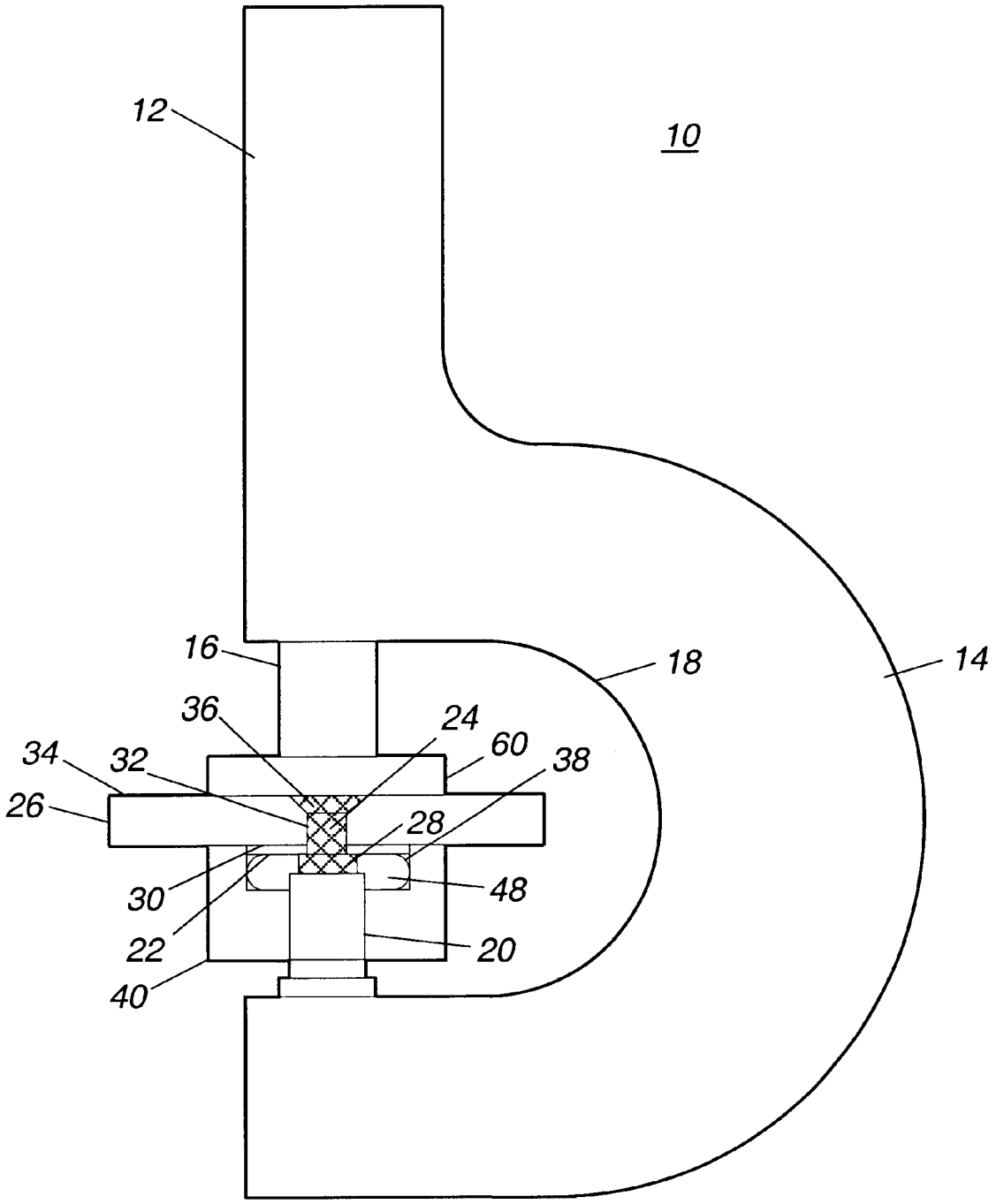
FIG. 1 is a side view of a rivet squeezer being used in association with a nutplate block, according to an embodiment of the present invention.

FIG. 1 is a side view of a hand-operated rivet squeezer 10 including a handle portion 12 and a U-shaped portion 14 defining an opening 18. This view of the rivet squeezer 10 is a general depiction and is intended to represent any suitable rivet squeezer known in the art, such as a hand-operated rivet squeezer or a pneumatic rivet squeezer, that is used to secure a nutplate to a part. The rivet squeezer 10 includes a reciprocating RAM 16 positioned at one side of the opening 18 and a stationary punch 20 positioned at an opposite side of the opening 18 and aligned with the reciprocating RAM 16. When the squeezer 10 is activated, the punch 20 extends toward the RAM 16 to close the gap therebetween. The operation of rivet squeezers in this manner is well understood to those skilled in the art.

In this diagram, the rivet squeezer 10 is being used to secure a nutplate 22 to a metal part 26 by two rivets 24, one of which is shown here. The nutplate 22 includes a base plate 30 and edges 38 that are formed around a connector (not shown). Nutplates of this type are well known to those skilled in the art. The rivet 24 is shown after it has been compressed by the squeezer 10 to form a rivet head 28. As is known in the art, the preformed rivet 24 is inserted into a counter-sunk bore 32 through a back surface 34 of the part 26 so that a triangular-shaped end portion 36 of the rivet 24 is positioned flush with the surface 34. A cap block 60 is used to simultaneously hold both of the unformed rivets 24 in place prior to securing the nutplate 22 to the part 26.

Figure 2:
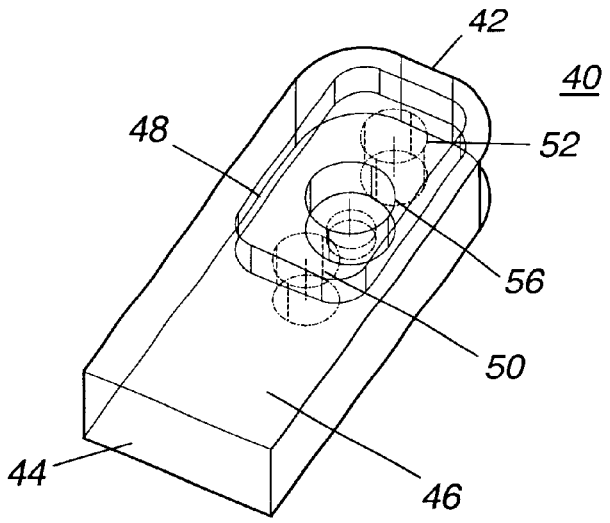
FIG. 2 is a perspective view of the nutplate block shown in FIG. 1, separated from the squeezer.
Figure 3:
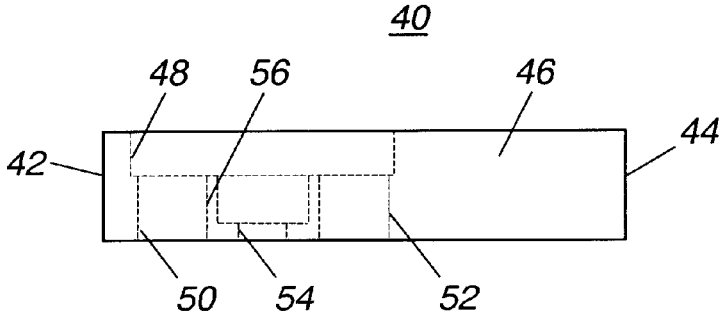
FIG. 3 is a side view of the nutplate block of the invention.
Figure 4:
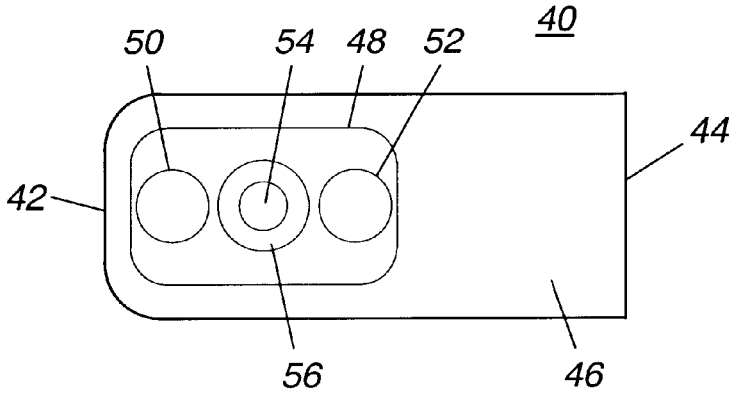
FIG. 4 is a top view of the nutplate block of the invention.

According to the present invention, a nutplate block 40 is used in combination with the squeezer 10 to align the punch 20 with the rivets 24, and increase the efficiency of the riveting operation. FIG. 2 shows a perspective view, FIG. 3 shows a side view and FIG. 4 shows a top view of the nutplate block 40 removed from the rivet squeezer 10. The nutplate block 40 is a general rectangular metal piece, made from steel in one example, that includes a rounded end portion 42 and a squared end portion 44. The nutplate block 40 includes a cavity 48 shaped and configured to hold the nutplate 22 in a secure manner. The block 40 includes a holding portion 46 that allows the rivet operator to easily grasp the nutplate 22 to position the nutplate block 40 into the opening 18, and easily remove it therefrom. First and second cylindrical bores 50 and 52 extend through the nutplate block 40 in the cavity 48. A center bore 54, including a counter sunk portion 56, extends through the nutplate block 40 between the bores 50 and 52. The bore 54 accepts the loosely held connector during the assembly operation.

In operation, the nutplate 22 is positioned face down within the cavity 48, and the nutplate block 40 is positioned against the part 26. The unformed rivets 24 are positioned in the counter-sunk bores 32 in the part 26 so that they extend through the holes in the nutplate 22 while it is being held in the nutplate block 40. The cap block 60 is then positioned against the back surface 34 of the part 26. The opening 18 of the squeezer 10 is then positioned around the combination of the nutplate block 40, the nutplate 22, the part 26 and the cap block 60. The operator aligns the punch 20 with the one of the bores 50 or 52 opposite the cavity 48 so that the punch 20 is aligned with one of the rivets 24. The operator then performs the riveting operation to form the head 28 to secure the nutplate 22 to the part 26. While the nutplate 22 is still positioned within the cavity 48, the punch 20 is aligned with the other bore 50 or 52 so that the other rivet 24 can be formed. In this manner, the nutplate block 40 provides a cost-effective way to speed up the riveting operation and reduces or eliminates the possibility of deformed rivet heads that must be drilled out and replaced.

In one embodiment, the nutplate block 40 is 1.437 inches long, 0.295 inches thick and 0.60 inches wide. The cavity 48 is 0.726 inches long, 0.413 inches wide, and 0.1165 inches deep. Additionally, the cavity 48 includes rounded corners having a 0.093 inch radius. The radius of the rounded corners of the end portion 42 are 0.218 inches. The bores 50 and 52 are 0.191 in diameter, the bore 54 is 0.136 inches in diameter, and the counter bore 56 is 0.25 inches in diameter and is 0.134 inches deep. The center of the bore 54 is 1.0 inches from the end 44, and the distance between the center of the bore 54 and the bore 50 is 0.25 inches.

Figure 5:
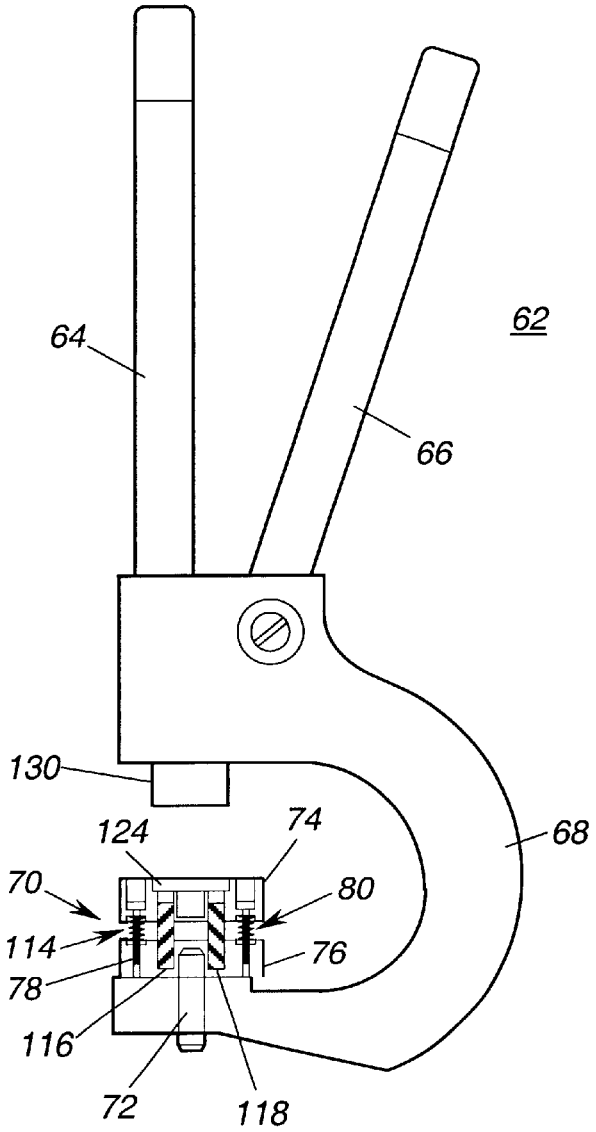
FIG. 5 is a side view of a rivet squeezer being used in connection with an automatic nutplate die, according to another embodiment of the present invention.

FIG. 5 is a plan view of a rivet squeezer 62 of the type discussed above being used in connection with an automatic nutplate die 70, according to another embodiment of the present invention. As will be discussed in detail below, the die 70 allows both of the rivets 24 to be simultaneously formed to secure the nutplate 22 to the part 26. The rivet squeezer 62 includes handles 64 and 66 and a U-shaped portion 68. The automatic nutplate die 70 includes a retention pin 72 that is inserted within an opening in the U-shaped portion 68 to be connected thereto. The retention pin 72 can be any retention device suitable to connect the die 70 to the squeezer 62 for the purposes discussed herein. A spacer (not shown) including a center bore that accepts the pin 72 can be positioned between the nutplate die 70 and the U-shaped portion 68 to provide the spacing necessary to accommodate different parts and different rivets.

Figure 6:
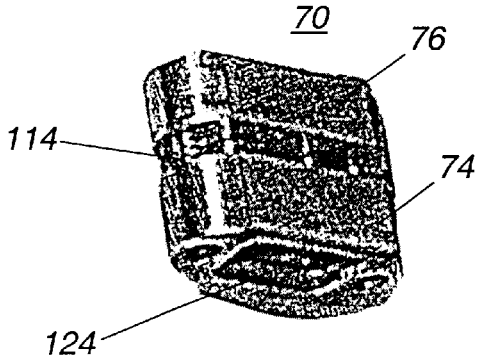
FIG. 6 is a perspective view of the automatic nutplate die shown in FIG. 5 removed from the rivet squeezer.
Figure 7:
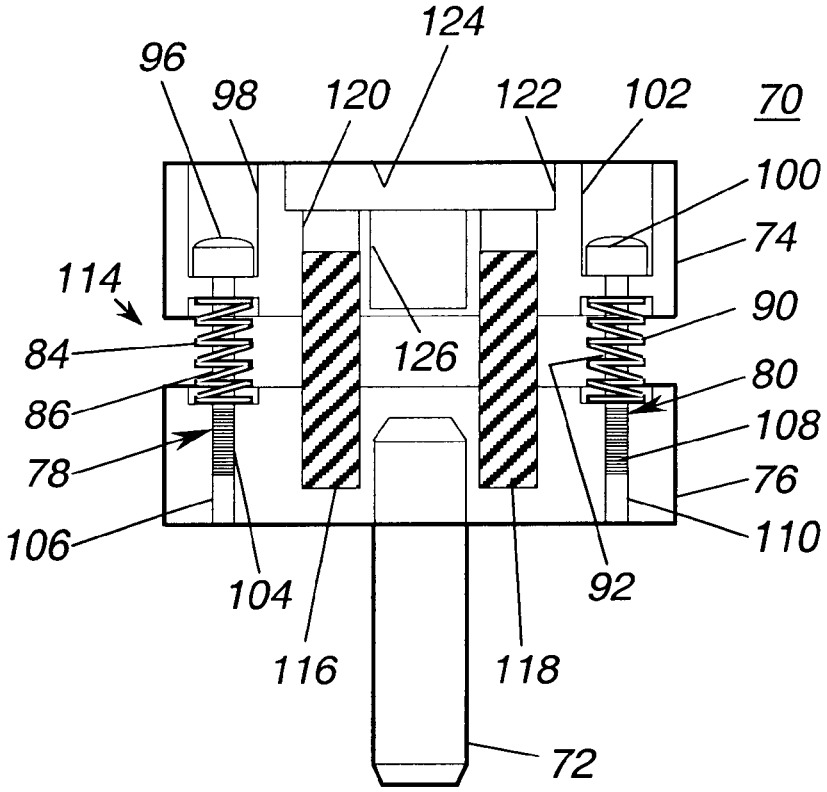
FIG. 7 is a cross-sectional view of the automatic nutplate die shown in FIG. 5 removed from the rivet squeezer.
Figure 8:
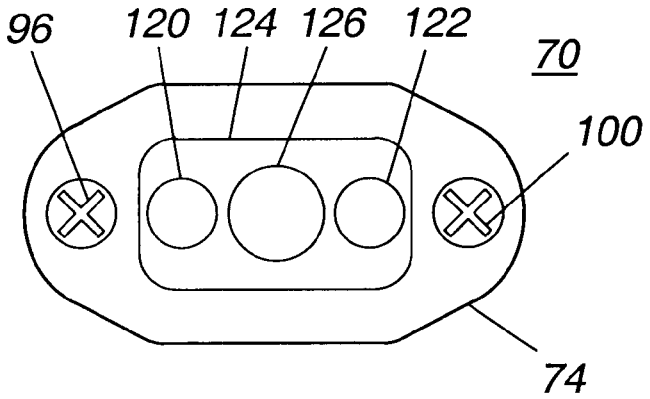
FIG. 8 is a top view of the automatic nutplate die removed from the rivet squeezer.

FIG. 6 is a perspective view, FIG. 7 is a cross-sectional view and FIG. 8 is a top view of the automatic nutplate die 70 removed from the rivet squeezer 62. The nutplate die 70 includes a nutplate platen 74 and a punch platen 76. The platens 74 and 76 are connected together by a pair of stripper bolts 78 and 80, where a spring member 84 is positioned around a shaft portion 86 of the bolt 78 and a spring member 90 is positioned around a shaft portion 92 of the bolt 80. The spring members 84 and 90 are positioned within recesses in opposing surfaces of the platens 74 and 76, as shown, so that they are maintained in place.

A head 96 of the bolt 78 is positioned within a counter bore 98 of the platen 74, and a head 100 of the bolt 80 is positioned within a counter bore 102 of the platen 74. Additionally, a threaded end 104 of the bolt 78 is threaded into a threaded opening 106 in the platen 76, and a threaded portion 108 of the bolt 80 is threaded into a threaded opening 110 in the platen 76. When the heads 96 and 100 of the bolts 78 and 80 are flush within the openings 98 and 102, and the threaded portions 104 and 108 are threaded a certain distance within the openings 106 and 110, a tightly controlled gap 114 is defined between the platens 74 and 76. The platens 74 and 76 are held apart by the spring members 84 and 90.

A first punch 116 and a second punch 118 are rigidly secured within the platen 76, as shown. Additionally, the first punch 116 and the second punch 118 are slidably positionable within bores 120 and 122, respectively, in the platen 74. The platen 74 further includes a retainer cavity 124 shaped and configured to accept the nutplate 22 (not shown in FIG. 5) in the same manner as the nutplate block 40. Thus, the cavity 124 can have the same dimension as the cavity 48. When the nutplate 22 is in the cavity 24, the rivet holes in the nutplate 22 are aligned with the bores 120 and 122. An opening 126 in the cavity 124 accepts the connector (not shown) of the nutplate 22.

In operation, the nutplate 22 is positioned within the cavity 124 and the part 26 is aligned with the die 70. The rivets 24 are then inserted through the part 26 and through the nutplate 22 in the usual manner. The gap 114 is set so that the rivets 24 extend into the top of the bores 120 and 122 a certain distance from the ends of the punches 116 and 118. The cap block 60 is positioned over the end portions 36 of the rivets 24. The handles 64 and 66 of the rivet squeezer 62 are closed together causing a squeezer punch 130 to be forced against the cap block 60. The platen 74 moves toward the platen 76 against the bias of the spring members 84 and 90, reducing the clearance of the gap 114. The heads 96 and 100 of the bolts 78 and 80 move away from the shoulder of the bores 98 and 102. The punches 116 and 118 simultaneously deform the end of the rivets 24 to form the rivet heads 28. When the platen 74 contacts the platen 76, the heads 28 of the rivets 24 are completely formed, and the rivet squeezer 10 is released. By tightly controlling the gap 114, the size of the heads 28 of the rivets 24 can be controlled. The bias of the spring members 84 and 90 cause the platen 76 to separate from the platen 74, until the heads 96 and 100 engage the counter bores 98 and 102.

The nutplate block 40 and the nutplate die 70 discussed above provide devices that can easily align a punch of a squeezer with the rivets being formed. Therefore, the rivets can be formed to secure the nutplate 22 to the part 26 with consistent high quality. This eliminates the need to drill out rivets that have been poorly formed. In addition, the nutplate die 70 allows both rivets 24 of the nutplate 32 to be simultaneously formed with one operation of the squeezer 62.

The foregoing discussion discloses and describes merely exemplary embodiments of the present invention. One skilled in the art will readily recognize, that various changes, modifications and variations can be made therein without departing from the spirit and scope of the invention as defined in the following claims.

What is claimed is:

1. A nutplate die used in conjunction with a rivet forming device for securing a nutplate to a part by a plurality of rivets, said die comprising:

a retention member adapted to be coupled to the rivet forming device to connect the die to the device;

a first platen rigidly secured to the retention member;

a plurality of punches rigidly secured to the first platen;

a second platen including a plurality of punch bores extending therethrough, each punch bore being aligned with and receiving a separate one of the plurality of punches in a slidable engagement, said second platen further including a cavity shaped to hold the nutplate; and at least one biasing device positioned between the first and second platens, wherein activation of the rivet forming device causes the second platen to move toward the first platen against the bias of the biasing device so that the punches move through the punch bores and simultaneously form the plurality of rivets to attach the nutplate to the part.

2. The die according to claim 1 wherein at least one biasing device includes a spring positioned over a shaft of a bolt, said bolt being threaded into one of the platens.

3. The die according to claim 2 wherein the bolt is threaded into the one platen a predetermined distance to define a gap between the first and second platens.

4. The die according to claim 2 wherein the other of the platens includes a counter-sunk bolt bore that accepts a head of the bolt.

5. The die according to claim 1 wherein at least one biasing device is two separate bolts and a spring positioned over a shaft of each bolt, each bolt including a threaded portion that is threaded into one of the platens and a head portion mounted within the other platen.

6. The die according to claim 1 wherein the cavity in the first platen includes a recessed portion positioned and configured to accept a connector of the nutplate.

7. The die according to claim 1 wherein the plurality of punches is two punches and wherein the second platen includes two punch bores for simultaneously forming two rivets to the nutplate.

8. A nutplate die for securing a nutplate to a part by two rivets, said die comprising:

a retention pin adapted to be coupled to a rivet forming device to connect the die to the device;

a punch platen rigidly secured to the retention pin;

first and second punches spaced apart from each other and rigidly secured to the punch platen;

a nutplate platen including first and second punch bores extending therethrough, the first punch bore being aligned with and receiving the first punch in a slidable engagement and the second punch bore being aligned with and receiving the second punch in a slidable engagement, said nutplate platen further including a cavity shaped and configured to hold the nutplate;

first and second bolts each including a threaded end, a bolt head and a bolt shaft therebetween, wherein the threaded end of each bolt is threaded into the punch platen a predetermined distance and wherein the head of each bolt is mounted within the nutplate platen in a counter-sunk bore so that punch platen and the nutplate platen are spaced from each by a predetermined distance; and a first spring mounted on the shaft of the first bolt and being in contact with opposing surfaces of the nutplate platen and the punch platen and a second spring mounted on the shaft of the second bolt and also being in contact with the opposing surfaces of the nutplate platen and the punch platen, wherein activation of the rivet forming device causes the nutplate platen to move towards the punch platen against the bias of the first and second springs so that the first and second punches move through the punch bores and simultaneously form the two rivets to attach the nutplate to the part.

9. The nutplate die according to claim 8 wherein the cavity in the nutplate platen includes a recessed portion positioned and configured to accept a connector of the nutplate.

10. The nutplate die according to claim 8 further comprising a spacer positioned on the retention pin.

* * * * *